United States Patent [19]

Beecher, II et al.

[11] 4,177,364

[45] Dec. 4, 1979

[54] MULTIPLE PUSHBUTTON SWITCH

[75] Inventors: Robert L. Beecher, II; Harold J. Hershey, both of Indianapolis, Ind.

[73] Assignee: Bell Telephone Laboratories, Incorporated, Murray Hill, N.J.

[21] Appl. No.: 889,497

[22] Filed: Mar. 23, 1978

[51] Int. Cl.[2] ..... H01H 9/26

[52] U.S. Cl. ..... 200/5 B; 74/483 PB; 200/5 E; 200/5 EA

[58] Field of Search ..... 200/5 R, 5 B, 5 E, 5 EA, 200/5 EB, 153 L, 153 LA, 328, 340; 74/483 PB, 568

[56] References Cited

U.S. PATENT DOCUMENTS

| | | | |
|---|---|---|---|
| 2,988,932 | 6/1961 | Swanson | 74/568 |
| 3,271,530 | 9/1966 | Wirsching | 200/5 |
| 3,517,140 | 6/1970 | Bailey et al. | 200/5 |
| 3,722,313 | 3/1973 | Schadow | 74/483 |
| 3,780,236 | 12/1973 | Gross | 200/5 |
| 3,908,101 | 9/1975 | Kuhfus | 200/5 EA |
| 3,970,806 | 7/1976 | Distler | 200/5 EX |

*Primary Examiner*—James R. Scott
*Attorney, Agent, or Firm*—Harry L. Newman

[57] ABSTRACT

A multiple pushbutton switch is disclosed in which each pushbutton actuator has a rotatable cam mounted thereon that interacts with one or more lockout members positioned alongside of the actuator in the same plane as the cam. The interaction between the cam and the lockouts is such that one group of the pushbutton actuators can be depressed simultaneously while a second group of the actuators are blocked from simultaneous depression with the first group. Furthermore, a pushbutton actuator can be shifted from one group to the other merely by rotating the cam thereon to a different position.

6 Claims, 5 Drawing Figures

MULTIPLE PUSHBUTTON SWITCH

TECHNICAL FIELD

This invention relates to the field of electrical switches and within that field to multiple pushbutton switches including cooperating elements that prevent the simultaneous actuation of selected ones of the switches.

BACKGROUND OF THE INVENTION

In the field of telephony, multiple pushbutton switches, referred to as keys, are used in key telephone sets to select central office or intercom lines. Each pushbutton operates an actuator that, when depressed, closes an associated switch to make the selection. When two or more pushbuttons are depressed simultaneously, the associated lines are interconnected, and all the parties connected to those lines are able to speak with one another in a conference call. While it is permissible to interconnect two or more central office lines together or two or more intercom lines together, it is not permissible to interconnect a central office line and an intercom line. This is because central office lines work off a 48-volt battery, and intercom lines normally work off of 24-volt systems.

One way of preventing conferencing of central office lines with intercom lines is disclosed in the copending application of R. L. Beecher, H. J. Hershey and R. S. Zieles, Ser. No. 790,461, filed Apr. 25, 1977 now U.S. Pat. No. 4,130,744 and assigned to the assignee of the present application. The pushbutton actuators in the key described therein are arranged in a row with the central office line selecting actuators in one group and the intercom line selecting actuators in a second group. Each actuator has an interlocking member mounted thereon that includes a disk, and a row of lockout members are positioned alongside of the actuators in the same plane as the disks. The lockout members are respectively positioned between the disks on the adjacent actuators, and the disk on each actuator is adapted to engage and laterally displace an associated lockout member when the actuator is depressed. Because the lockout members are closely spaced, this results in the displacement of other lockout members.

The lockout members have three different shapes. Lockout members of a half triangular-like shape are positioned between adjacent central office line selecting actuators. This half triangular-like shape is such that only an inclined shoulder portion on one side of the lockout members is engageable by the disks on these actuators. The engagement with that shoulder portion results in the lateral displacement of the lockout members toward the group of intercom line selecting actuators.

Lockout members of a half triangular-like shape that is the reverse of the foregoing lockout members are positioned between adjacent intercom line selecting actuators. Thus, again only an inclined shoulder portion on one side of the lockout members is engageable by the disks on these actuators. The engagement with that shoulder portion results in the displacement of the lockout members toward the group of central office line selecting actuators.

Finally, a lockout member of a full triangular-like shape is positioned between the central office line selecting actuator and intercom line selecting actuator that are adjacent to one another. This shape is such that an inclined shoulder portion on one side of the lockout member is engageable by the disk on the central office line selecting actuator so as to be displaced toward the intercom line selecting actuators. In addition, an inclined shoulder portion on the other side of the lockout member is engageable by the disk on the intercom line selecting actuators so as to be displaced toward the central office line selecting actuators.

As a result of the foregoing relationships, when one or more central office line selecting actuators are depressed, the lockout members are laterally displaced to a position wherein the disks on the intercom lines selecting actuators are blocked by the shoulder portions of the lockout members associated therewith. Thus, no intercom line selecting actuator can be depressed at the same time that a central office line selecting actuator is depressed. In a like manner, when one or more of the intercom line selecting actuators are depressed, the lockout members are laterally displaced to a position wherein the disks on the central office line selecting actuators are blocked by the shoulder portions of the lockout members associated therewith. Thus, no central office line selecting actuator can be depressed at the same time that an intercom line selecting actuator is depressed.

The problem with this arrangement is that should a customer decide to have more intercom lines and fewer central office lines or vice versa, it is necessary to disassemble the key and change one or more lockout members in order to provide the necessary interlock feature. Consequently, this modification is more appropriately done at a service center rather than on the customer's premises.

SUMMARY OF THE INVENTION

The present invention permits this modification to be done so simply that it can be readily carried out on the customer's premises. In accordance with applicants' invention, the lockout members all have the same shape. In an illustrative embodiment, this is the full triangular-like shape whereby each lockout member has opposed inclined shoulder portions. In addition, the disk of the interlocking member on each pushbutton actuator is replaced by a cam that is rotatable between two positions. The cam is shaped such that in a first of the two positions, it is engageable only with the shoulder portion of the lockout member on its right. In the second position of the cam, it is engageable only with the shoulder portion of the lockout member on its left. The cams on the central office line selecting actuators are all rotated to the position wherein the lockout members are deflected toward the intercom line selecting actuators. The cams on the intercom line selecting actuators are all rotated to the opposite position wherein the lockout members are deflected toward the central office line selecting actuators.

This relationship produces the same results as the arrangement disclosed in the copending application. That is, central office line selecting actuators and intercom line selecting actuators cannot be simultaneously depressed. However, with applicants' invention, should the customer decide to change the mix of central office and intercom lines that are connected to his/her key telephone set, the key can be easily modified to provide the necessary interlock feature without disassembling the key. It is accomplished by simply rotating the appropriate cam(s) to the other position.

DETAILED DESCRIPTION

Figure 1:
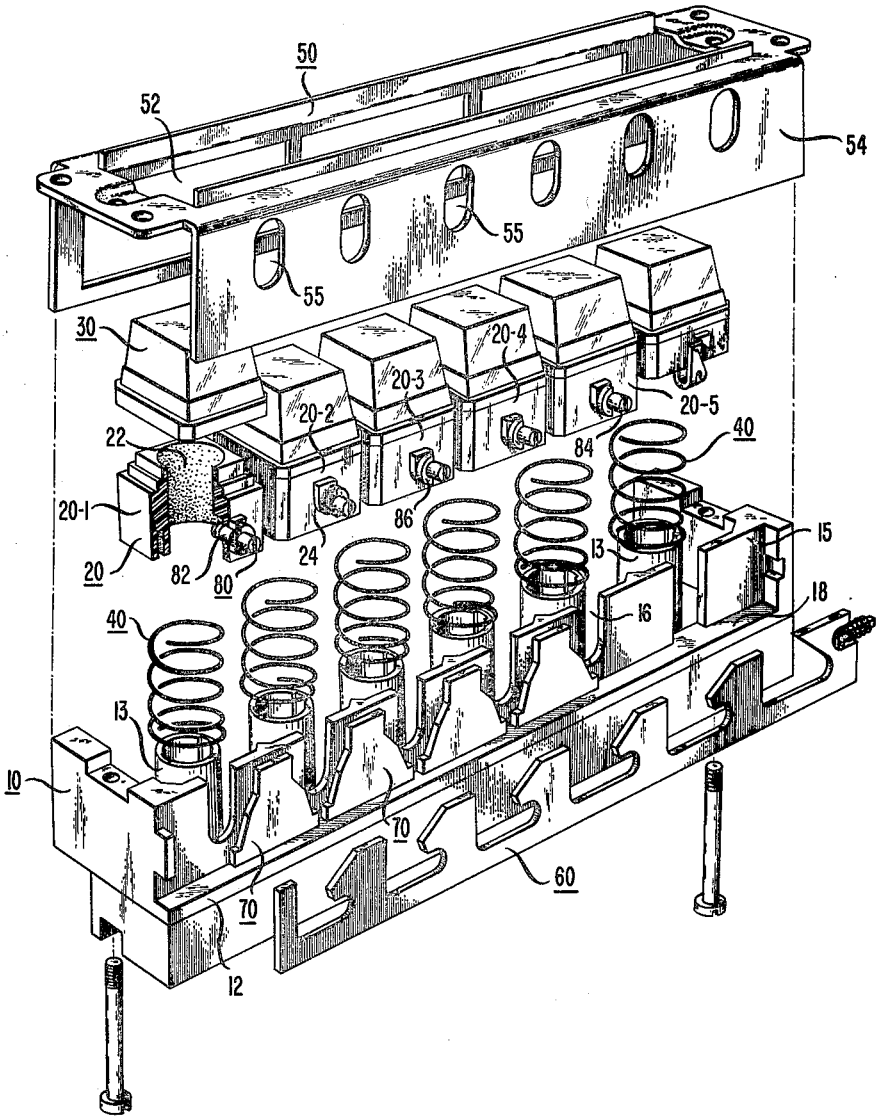
FIG. 1 is an exploded perspective view of a multiple pushbutton switch embodying the present invention.

Referring to FIG. 1 of the drawing, there is shown a multiple pushbutton switch of the type disclosed in U.S. Pat. No. 3,271,530 issued to R. E. Wirsching on September 6, 1966. The switch includes a housing 10 having a row of sleeve portions 13 and a longitudinal wall portion 15 extending parallel to the sleeve portions. The longitudinal wall portion 15 has a plurality of equally spaced guide slots 16 therein, and each guide slot is in alignment with an individual sleeve portion 13. In addition, the longitudinal wall portion 15 has a rectangular recess 18.

An actuator 20 having a central aperture 22 that conforms to the sleeve portion 13 is disposed about each sleeve portion. In addition, each actuator 20 includes a raised guide portion 24 on one side thereof that is accommodated by the adjacent guide slot 16 in the longitudinal wall portion 15. These elements cooperate to permit each actuator 20 to move up and down along the length of its associated sleeve portion 13 but prevent the actuator from rotating about the sleeve portion.

The opposite side of each actuator 20 includes a spring engaging portion (not shown) that extends into juxtaposition with individual ones of a plurality of contact springs (not shown). The engaging portions deflect the contact springs into and out of engagement with adjacent contact springs responsive to the up and down movement of the actuator 20.

A button 30 is snap mounted to the upper end of each actuator 20, while a compression spring 40 which is disposed about each sleeve portion 13 biases the actuator 20 upwardly. The upward movement of the actuator 20 is limited by the engagement of the guide portions 24 thereon with a cover member 50. The cover member 50 is disposed about and fastened to the housing 10, and the top of the cover member is provided with elongated opening 52 that is of a size to permit the buttons 30 but not the guide portions 24 of the actuators 20 to pass therethrough. In addition, the cover member 50 includes a skirt portion 54 that cooperates with the longitudinal wall portion 15 to retain a latch bar 60 and a plurality of lockouts 70 within the recess 18 in the wall portion. The latch bar 60 and lockouts 70 interact with interlocking members 80 respectively mounted on the guide portions 24 of the actuators 20.

Figure 2:
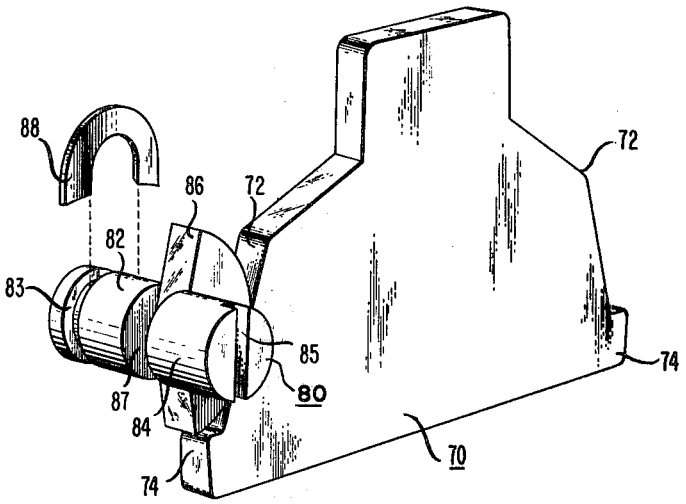
FIG. 2 is a perspective view showing the front and one side of one of the interlocking members and the lockout member to one side of it.
Figure 3:
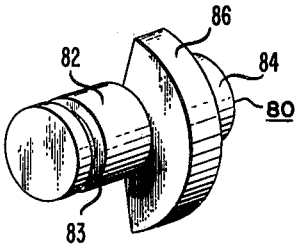
FIG. 3 is a perspective view showing the rear and the other side of the interlocking member.
Figure 4:
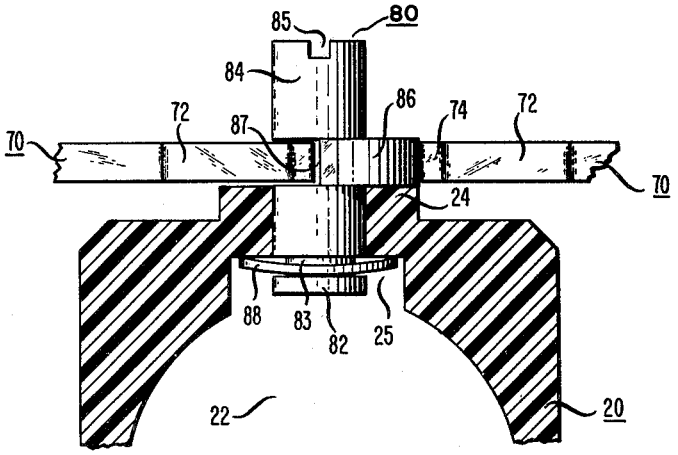
FIG. 4 is a top view partially in cross section showing the manner in which the interlocking members are mounted on the pushbutton actuators and the spatial relationship between the cam portions and the lockout members to one side.

Referring to FIGS. 2, 3 and 4 in accordance with the present invention, each interlocking member 80 comprises a cylindrical mounting portion 82 at its rear, a pin portion 84 at its front, and a cam portion 86 in between. As shown in FIG. 4, the mounting portion 82 is accommodated by a complementary transverse opening in the actuator 20 that communicates with a slot 25 formed in the portion of the wall of the central aperture 22 in juxtaposition with the guide portion 24. The length of the mounting portion 82 is such that with the cam portion 86 abutting the front of the guide portion 24, the rear end of the mounting portion does not extend into the aperture 22. Thus, the mounting portion 82 does not interfere with the up and down movement of the actuator 20 on sleeve 13.

In addition, the mounting portion 82 includes a peripheral groove 83 adjacent to its rear end, and the dimensions of the mounting portion are such that with the cam portion 86 abutting the front of the guide portion 24, the groove is located immediately adjacent to the front of the slot 25. Then, by positioning a C-shaped spring clip 88 over the groove 83, the interlocking member 80 is secured rotatively in place. The front of the pin portion 84 advantageously includes a slot 85 of a size to accommodate the blade of the screw driver so that the interlocking member 80 can be readily rotated.

The cam portion 86 of the interlocking member 80 has the shape of a sector of a circle, that is, it has two radially extending flat sides joined by an arcuate side. The center of the cam portion 86 is coincident with the longitudinal axis of the mounting portion 82 and pin portion 84, and the angle subtended by the flat side is somewhat less than 180 degrees. The thickness of the cam portion 86 is slightly greater than the thickness of the lockout members 70. Consequently, when the interlocking member 80 is mounted on its associated actuator 20, the distance between the rear of the pin portion 84 and the front of the guide portion 24 of the actuator is also greater than the thickness of the lockout members 70. A groove 87 is thereby provided, that is, adapted to accommodate the edge of an adjacent lockout member 70.

Referring again to FIG. 1, the pin portions 84 of the interlocking members 80 extend into the plane of the latch bar 60 and interact with the latch bar in the manner described in the above-noted Wirsching patent. That is, the pin portions 84 and latch bar interact to latch the actuators 20 in a downward position when any one of them is depressed and at the same time permit any previously latched-down actuator to return to its upward position under the bias of its compression spring 40.

Similarly, as shown in FIG. 2, the cam portions 86 of the interlocking members 80 lie in the same plane as the lockout members 70, the lockout members having a triangular-like shape including a pair of inclined shoulder portions 72 and an enlarged base portion 74. However, the cam portions 86 interact with the lockout members 70 in a totally different manner than the arrangement disclosed in the Wirsching patent. The cam portions 86 cooperate with the lockout members 70 to permit only selected ones of the actuators 20 to be depressed simultaneously.

Figure 5:
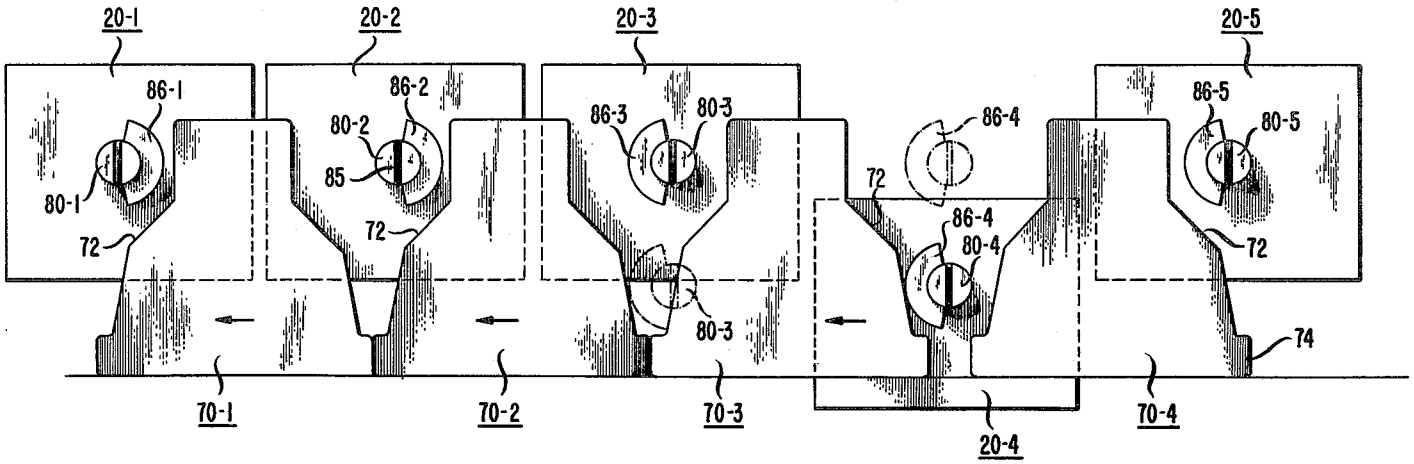
FIG. 5 is front view showing the interaction between the cam portions of the interlocking members and the lockout members.

With the cam portions 86 arranged in the manner shown in FIG. 5, that is, with the cam portions 86-1 and 86-2 extending toward the right and the cam portions 86-3, 86-4 and 86-5 extending toward the left, the actuators 20-1 and 20-2 can be depressed simultaneously, or the actuators 20-3, 20-4 and 20-5 can be depressed simultaneously. But neither of the actuators 20-1 or 20-2 can be depressed simultaneously with any of the actuators 20-3, 20-4 or 20-5. This is because of the following:

When, for example, the actuator 20-4 is moved to its downward position, the cam portion 86-4 engages the right hand shoulder portion 72 on the lockout member 70-3 and deflects the lockout member to the left. As a result, the base portion 74 of the lockout member 70-3 engages the base portion of the lockout member 70-2 which in turn engages the base portion of the lockout member 70-1, and they end up in the positions shown in FIG. 5.

It is seen that in this position of the lockout members 70, the downward movement of the cam portion 86-3 is not blocked by the shoulder portions 72 on either of the lockout members 70-2 or 70-3. Thus, the actuator 20-3 can be depressed simultaneously with the actuator 20-4, and when so depressed, the groove 87 of the interlocking member 80-3 moves over the shoulder portion 72 of the lockout member 70-3 in the manner shown in FIG. 4.

Similarly, if the actuator 20-5 is depressed, the cam portion 86-5 of the interlocking member 80-5 merely deflects the lockout member 70-4 into abutting engagement with the lockout member 70-3, the shoulder 72 of the lockout member being moved into the groove 87 of the interlocking member 80-4 to the position shown in FIG. 4. Thus, the actuators 20-3, 20-4 and 20-5 can all be depressed simultaneously.

Conversely, it is seen that with the lockout members 70 positioned as shown in FIG. 5, the downward movement of both the cam portions 86-1 and 86-2 are blocked by the shoulders 72 on the lockout members 70-1 and 70-2. Therefore, neither of the actuators 20-1 and 20-2 can be depressed simultaneously with the actuators 20-3, 20-4 or 20-5. However, for the same reasons that the actuators 20-3, 20-4 and 20-5 can be depressed simultaneously with one another, the actuators 20-1 and 20-2 can be depressed simultaneously with one another. The lockout members 70 will then be shifted to the right to block the downward movement of the actuators 20-3, 20-4 and 20-5.

If, for example, it is found desirable to have the actuator 20-3 depressable simultaneously with the actuators 20-1 and 20-3, rather than with the actuators 20-4 and 20-5, all that is necessary is to rotate the interlocking member 80-3 one hundred and eighty degrees to place the cam portion 86-3 on the right. This is accomplished without having to disassemble the multiple pushbutton switch. Since the slot 85 in the front end of each interlocking member 80 is exposed through an opening 55 (FIG. 1) in the skirt 54 of the cover 50, the interlocking members are readily rotated by means of a screwdriver. Furthermore, if it is found desirable to prevent any of the actuators 20 from being depressed simultaneously with one another, this is achieved by merely rotating all of the interlocking members 80, ninety degrees to have the cam portions 86 extend downward.

Although a specific embodiment of the invention has been shown and described, it will be understood that it is but illustrative and that various modifications may be made without departing from the scope and spirit of this invention as defined in the appended claims.

We claim:

1. A multiple pushbutton switch of the type including one or more lockout members (70) and pushbutton actuators (20) having lockout engaging elements (80) attached thereto adapted to engage and displace the lockout members when one or more of the actuators is depressed, the interaction between the lockout engaging elements of the lockout members limiting the simultaneous depression of the actuators, characterized in that the lockout engaging elements comprise cams (86) rotatably oriented by adjustment among a plurality of positions, each cam in a first position of rotation oriented adjacent to a particular lockout member, being engageable with that lockout member when the associated actuator is depressed and each cam oriented in a second position of rotation not being engageable with the particular adjacent lockout member when the associated actuator is depressed.

2. A multiple pushbutton switch as in claim 1 wherein each cam oriented in its first position of rotation is only engageable with an adjacent lockout member to its right, and each cam oriented in its second position of rotation is only engageable with an adjacent lockout member to its left.

3. A multiple pushbutton switch as in claim 2 wherein each cam oriented in a third position of rotation is engageable with both an adjacent lockout member to its right and an adjacent lockout member to its left.

4. A multiple pushbutton switch as in claims 1 or 2 wherein a first group of adjacent pushbutton actuators have the cams attached thereto oriented in one of the two positions of rotation and a second group of adjacent pushbutton actuators have the cams attached thereto oriented in the other of the two positions, the positions being selected so that whenever one of the pushbutton actuators of the first group is depressed, the engagement of the cam thereon with an associated lockout member results in the displacement of the lockout members toward the second group, and whenever one of the pushbutton actuators of the second group is depressed, the engagement of the cam thereon with an associated lockout member results in the displacement of the lockout members toward the first group.

5. A multiple pushbutton switch as in claim 1 wherein each cam comprises a portion of an interlocking member, each interlocking member also including a cylindrical mounting portion that extends rearwardly from the cam portion and is accommodated by a complementary opening in the associated pushbutton actuator, the mounting portion including a peripheral groove over which a spring clip is placed to rotatively secure the interlocking member to the pushbutton actuator.

6. A multiple pushbutton switch as in claim 5 wherein the cam portion has the shape of a sector of a circle, the center of which is coincident with the longitudinal axis of the mounting portion.

* * * * *